US009121144B2

(12) United States Patent
Medinger

(10) Patent No.: US 9,121,144 B2
(45) Date of Patent: Sep. 1, 2015

(54) METHOD FOR COMPACTING SOIL, APPLICATIONS OF THIS METHOD AND DEVICES FOR ITS IMPLEMENTATION

(75) Inventor: Jean-Claude Medinger, Bourg la Reine (FR)

(73) Assignee: SC MEDINGER R&D, Bourg la Reine (FR)

( * ) Notice: Subject to any disclaimer, the term of this patent is extended or adjusted under 35 U.S.C. 154(b) by 160 days.

(21) Appl. No.: 13/069,531

(22) Filed: Mar. 23, 2011

(65) Prior Publication Data

US 2011/0236140 A1 Sep. 29, 2011

(30) Foreign Application Priority Data

Mar. 23, 2010 (FR) ..... 10 01152

(51) Int. Cl.

| | |
|---|---|
| ***E02D 3/02*** | (2006.01) |
| ***E01C 21/00*** | (2006.01) |
| ***E01B 27/00*** | (2006.01) |
| ***E02D 3/026*** | (2006.01) |
| ***E02F 5/02*** | (2006.01) |
| ***E02F 5/10*** | (2006.01) |
| ***E02F 9/28*** | (2006.01) |

(52) U.S. Cl.

CPC ..... *E01C 21/00* (2013.01); *E01B 27/00* (2013.01); *E02D 3/026* (2013.01); *E02F 5/027* (2013.01); *E02F 5/103* (2013.01); *E02F 9/2816* (2013.01)

(58) Field of Classification Search

CPC ..... E02F 5/105; A01B 13/08; A01B 15/025
USPC ..... 405/271, 174, 180, 181, 182, 179, 183; 404/121, 124–129; 299/87.1
See application file for complete search history.

(56) References Cited

U.S. PATENT DOCUMENTS

| | | | | | |
|---|---|---|---|---|---|
| 1,333,492 | A | * | 3/1920 | Kalteis | 404/128 |
| 1,854,617 | A | * | 4/1932 | Maloon | 405/183 |
| 2,211,262 | A | | 8/1940 | Flynn | |
| 2,284,178 | A | * | 5/1942 | Sublett | 172/702 |
| 2,501,062 | A | * | 3/1950 | Le Tourneau | 405/181 |
| 3,063,176 | A | * | 11/1962 | Larson | 37/453 |
| 3,083,542 | A | * | 4/1963 | Summers et al. | 405/179 |
| 3,122,111 | A | * | 2/1964 | Taylor, Sr. | 111/80 |
| 3,427,990 | A | | 2/1969 | Bryan, Jr. | |
| RE26,718 | E | * | 11/1969 | Kelley | 405/180 |
| 3,503,456 | A | * | 3/1970 | Larson | 172/484 |

(Continued)

FOREIGN PATENT DOCUMENTS

| | | | |
|---|---|---|---|
| FR | 1455801 | A | 5/1966 |
| FR | 2789415 | A1 | 8/2000 |

(Continued)

OTHER PUBLICATIONS

French Search Report in Corresponding Application No. FA 737970/FR 1001152 dated Jan. 27, 2011.

(Continued)

*Primary Examiner* — Doug Hutton, Jr.
*Assistant Examiner* — Patrick Lambe
(74) *Attorney, Agent, or Firm* — Young & Thompson

(57) ABSTRACT

Methods of compacting soil, and devices for carrying out the methods are provided in which an underground compacting device is inserted into the soil at a predetermined depth under which the compaction by the upper level of the soil becomes ineffective.

20 Claims, 12 Drawing Sheets

(56) References Cited

U.S. PATENT DOCUMENTS

| | | | | | |
|---|---|---|---|---|---|
| 3,575,006 | A * | 4/1971 | Rugroden et al. | 405/182 |
| 3,623,247 | A * | 11/1971 | Stepe | 7/455 |
| 3,627,056 | A * | 12/1971 | Rogers | 172/10 |
| 3,667,550 | A * | 6/1972 | Lehman | 172/700 |
| 3,935,712 | A * | 2/1976 | Erickson et al. | 405/182 |
| 3,952,810 | A * | 4/1976 | Ulrich | 172/40 |
| 3,959,901 | A * | 6/1976 | Klett | 37/452 |
| 4,023,288 | A * | 5/1977 | Roe | 37/403 |
| 4,127,073 | A * | 11/1978 | Blair | 111/123 |
| 4,253,412 | A * | 3/1981 | Hogenson | 111/150 |
| 4,348,134 | A * | 9/1982 | Goehler | 404/129 |
| 4,379,655 | A * | 4/1983 | Brost et al. | 405/176 |
| 4,475,602 | A * | 10/1984 | Gerstner | 172/713 |
| 4,637,755 | A * | 1/1987 | Tollefson et al. | 405/181 |
| 4,691,645 | A * | 9/1987 | Anderson | 111/155 |
| 4,773,340 | A * | 9/1988 | Williams et al. | 111/124 |
| 5,090,141 | A * | 2/1992 | Hall | 37/367 |
| 5,396,963 | A * | 3/1995 | Curry | 172/701.3 |
| 5,415,236 | A * | 5/1995 | Williams | 172/699 |
| 5,540,288 | A * | 7/1996 | Dietrich, Sr. | 172/196 |
| 5,562,055 | A * | 10/1996 | Petersen | 111/195 |
| 5,605,196 | A * | 2/1997 | Grimm et al. | 172/266 |
| 5,865,131 | A * | 2/1999 | Dietrich et al. | 111/121 |
| 6,135,567 | A * | 10/2000 | Cochran | 299/39.6 |
| 6,178,900 | B1 * | 1/2001 | Dietrich, Sr. | 111/119 |
| 6,234,718 | B1 * | 5/2001 | Moffitt et al. | 405/182 |
| 6,299,381 | B1 * | 10/2001 | Liebrecht, Jr. | 405/181 |
| 6,325,156 | B1 * | 12/2001 | Barry | 172/518 |
| 6,332,412 | B1 * | 12/2001 | Swab et al. | 111/152 |
| 6,397,767 | B1 * | 6/2002 | Dietrich, Sr. | 111/119 |
| 6,640,731 | B1 * | 11/2003 | Rowlett et al. | 111/152 |
| 7,059,257 | B2 * | 6/2006 | Summach et al. | 111/152 |
| 7,524,142 | B2 * | 4/2009 | Scott | 405/181 |
| 7,588,091 | B1 * | 9/2009 | Neudorf et al. | 172/773 |
| D615,998 | S * | 5/2010 | Kovach et al. | D15/29 |
| 7,784,559 | B1 * | 8/2010 | Raper et al. | 172/700 |
| 8,087,471 | B2 * | 1/2012 | Kovach et al. | 172/730 |
| 2002/0157285 | A1 * | 10/2002 | Hall | 37/367 |
| 2003/0234569 | A1 * | 12/2003 | Dawood | 299/108 |
| 2004/0200627 | A1 * | 10/2004 | Hoelting et al. | 172/701.3 |
| 2006/0233615 | A1 * | 10/2006 | Searby | 405/180 |
| 2007/0286681 | A1 * | 12/2007 | Parent | 405/174 |
| 2007/0292211 | A1 * | 12/2007 | Mitchell | 405/179 |
| 2008/0159812 | A1 | 7/2008 | Joly | |
| 2008/0257574 | A1 * | 10/2008 | Gonzalez | 172/192 |
| 2009/0136300 | A1 * | 5/2009 | Hoelting et al. | 405/180 |
| 2009/0208297 | A1 * | 8/2009 | Schulenberg et al. | 405/271 |
| 2010/0044061 | A1 * | 2/2010 | Harvey et al. | 172/40 |

FOREIGN PATENT DOCUMENTS

| | | | |
|---|---|---|---|
| FR | 2882377 | A1 | 8/2006 |
| WO | 03/024193 | A1 | 3/2003 |
| WO | 2010/006382 | A1 | 1/2010 |

OTHER PUBLICATIONS

European Search Report, dated Jan. 12, 2013, from corresponding EP application.

* cited by examiner

Section AA

METHOD FOR COMPACTING SOIL, APPLICATIONS OF THIS METHOD AND DEVICES FOR ITS IMPLEMENTATION

CROSS REFERENCE TO RELATED APPLICATIONS

Applicant claims priority under 35 U.S.C. 119 of French patent application no. 1001152 filed on 23 Mar. 2010.

BACKGROUND OF THE INVENTION

The present invention relates to methods for compacting soils. It aims at increasing the density of the materials in depth, so as to improve the geotechnical characteristics of the considered layer. It concerns new construction works such as construction of foundation layers for road structures, airport structures, railway structures, etc., as well as the maintenance and repair works performed under a railway, without having to proceed to the removal of the rails and of the ties.

It is known that compaction of soils or granular materials spread into a layer is usually carried out by means of compactors moving on the upper part of the layer. The compactors thus apply to the upper part of the layer an effort that will induce a pressure within the material and cause the irreversible deformations of compaction. The stresses induced within the material decrease as the depth increases and consequently the density obtained by compaction is not uniform throughout the thickness of the layer. Thus, the density distribution within the compacted material also decreases as the depth increases.

It is known in the current state of the art to choose the compactors and to define their operating characteristics according to the soil and materials and to the layer thickness in order to obtain a satisfactory density of the layer bottom, provided that the layer thickness is not too important.

Therefore, for silt or clay like soils treated with an hydraulic binder (in particular silts, more or less clayey fine sands), the maximum thickness of the compacted layer is in practice limited to 30 or 35 centimeters, because the use of the heaviest vibrating equipments would cause a surface lamination detrimental to the long term behavior/performance of the structure.

The study and calculation methods for the structures in a treated soil take of course into account the current state of the technology. It is for instance well accepted that the required density of the layer bottom shall be of 96% of the standard Proctor density (reference used in road geotechnics). It is to be noted that if a density of layer bottom equal to 100% of the standard Proctor optimum could be guaranteed, the dimensioning of the layer, with the same lifetime, could be reduced by about 20%.

It is also known that if the thickness of a foundation layer in a treated soil could be increased by 5 centimeters, with a density of the layer bottom equal to 100% of the Proctor optimum, its lifetime would be multiplied at least by 10.

Moreover, the difficulties relating to the control of this basic parameter of the compactness of the achieved layer bottom, in particular its fatigue strength, lead to take into account high safety factors.

It therefore appears that the capacity to compact the lower part of the layer and, more generally, to compact beyond the physical limits imposed by the compaction from the surface, would constitute an essential interest. It would then be possible to obtain higher compactnesses at the layer bottom and to make road layers which are thicker and in a reduced number.

It is also known that compacting the soil beneath an existing structure is not possible.

Thus, in the case of railways laid on a distribution layer made of ballast, maintenance works, without having to remove the tracks, enable the reconditioning or replacement of the ballast layer, but without the possibility to adjust and compact its base layer.

The ballast is therefore applied on a distorted support with low bearing where the rainwater stagnates and accelerates deteriorations. After two or three interventions of this type, it is necessary to reconstruct or construct a foundation layer under the ballast layer. This work requires removal of the tracks and traffic disruption over a long period.

BRIEF SUMMARY OF THE INVENTION

To solve these problems, the invention provides a method and devices that allow to compact in thickness the soil below a covering or below an existing structure such as a railway.

According to a first feature, in a first stage, a soil compacting device is inserted into the soil at a specified depth H, and in a second stage, said device is advanced while maintaining it at the specified depth, which allows to compact the soil continuously at a depth where the methods for compacting from above the soil become ineffective.

According to another feature, a device for carrying out the invention comprises a wedge-shaped tooth whose leading edge is facing forward in order to separate the upper layers of the soil, this tooth being attached on a frame by means of an intermediate part serving as a common support for the tooth and for a blade which is also attached to the rear of the tooth and has a curved shape whose concavity is directed upward, whose front is at the bottom level of the separated soil and whose lowest portion is at the desired level of compaction for a single pass of the device.

According to another feature, the blade is thick enough not to bend under the forces of compaction and its profile has a curved shape, corresponding to the desired average eccentricity.

According to another feature, the blade acts itself as a spring or is attached to its front end by a transverse joint and is maintained in a compressed state by a spring.

According to another feature, the device comprises a wedge-shaped tooth whose leading edge is directed forward in order to separate the upper layers of the soil and whose bottom portion is tilted downward to perform a first compaction at an intermediate level, said tooth being attached to a frame by means of an intermediate part which also supports, at the back of the tooth, a compacting roller for performing a second compaction to obtain the desired level, said roller being smooth or ridged, or supporting sheep's foot rollers.

According to another feature, the device comprises a single wear blade tilted from front to rear to separate the upper layers of the soil, this blade being attached on a frame by means of an intermediate part serving as a common support for the blade and for a set of rollers attached to a second intermediate part which in turn is attached to the first part, these rollers being disposed substantially next to each other, parallel to the soil surface and perpendicular to the direction of motion of the device, the first of these rollers further being located slightly below the tip of the wear blade, and other rollers being slightly shifted along the depth direction so that the last is at the desired level for the depth of compaction h.

According to another feature, the device comprises an intermediate part provided with a known support, which includes a longitudinal hole for receiving soil decompacting tools, such as a chisel or a tooth, wherein a flat part is attached at the lower portion of said support, said flat part being on the lower end of said support, said flat part being provided, at its lower portion, with a first vertical fin with a hole at the front and, at its rear, with three holes spaced in the height direction, this assembly forming said intermediate part, and wherein the device also includes a compacting part provided with a blade having a curved shape whose concavity is directed upward, said blade reproducing the curve of settlement under the repeated effect of the passages of a compactor acting from the surface, said blade comprising a second vertical fin attached on the upper portion of the blade and being itself provided with a hole at the front and, at its rear, with three holes spaced in the height direction, these two fins being positioned against one another by aligning the two front holes and by pushing into these two holes fastening means which allow rotation of the second fin on the surface of the first fin, the rear holes on each of these fins being spaced so that when the second fin rotates on the first fin, only one hole of the rear holes thereof corresponds to only one rear hole of the first fin, which allows to obtain three positions of the fins relative to each other and thus three different eccentricities for said blade.

According to another feature, a tractor vehicle is used to drive a rigid frame provided with means to maintain, at a specified and adjustable depth H under the soil level, a set of above-defined devices of the invention.

According to another feature, said frame is subjected to a vibratory movement and the frame is decoupled from the tractor vehicle, regarding vibrations, by an elastic fastener.

According to another feature, a rotor having at least one star provided with a set of spokes is used, a device according to the invention being attached to the end of at least one of these spokes, said rotor being rotated and being disposed under a protective hood, the whole assembly being driven in a translation movement which is horizontal and perpendicular to the axis of the rotor to compact a land strip with a width slightly smaller than the width of the hood.

According to another feature, the direction of rotation of the rotor is the same as the direction of motion of the whole assembly.

According to another feature, the rotor/hood assembly is attached on a carrier vehicle at the front, at the middle or at the rear of said vehicle.

According to another feature, the invention is implemented in a stabilizer comprising a rotor provided with stars, at least one the stars being provided with one above-mentioned device, and said star having at least one thick tooth which wears at the same rate as said device.

According to another feature, the invention is implemented by a device that includes at least one above-mentioned blade, said device being attached to the end of two arms rotatable on a horizontal axis perpendicular to the longitudinal axis of said device, the device comprising means to rotate the arms so as to keep the device under the level of the ballast of a railway track, and it also includes means for tensioning said compacting blade.

According to another feature, the device comprises at least two other devices provided with a blade, these two blades being transversely distributed between ribs and between side faces, on one or more rows at the same depth or at different depths, to form a rigid frame, which allows to compact in a single pass a thick layer to form a base compacted at the desired density.

According to another feature, said blades are spaced in the height direction to obtain a compacted layer whose height is greater than the height that can be achieved with a single pass.

According to another feature, the compacting device comprises, before the actual compacting means, a small diameter shaft provided with easily exchangeable picks, to form a small milling tool allowing to separate the soil from the ballast before said compacting means in order to facilitate adjustment and compaction of said layer, the driving of the rotor being effected by a motor reducer located within upright posts forming a chamber.

According to another feature, the device is intended for the treatment of soils under the ballast of railway tracks, and it comprises means for the initial earthwork of at least one trench to engage the engine of a milling tool, means to ensure the leveling of a binder, means for mixing said binder with said soil, and means for compacting this mixture into a thick layer, and these mixing means comprise a large diameter milling tool having a horizontal axis perpendicular to the direction of motion of a railcar and on which are fixed members such as teeth, which allows the mixing of the entire soil subjected to treatment with said hydraulic binder.

According to another feature, this device includes probes, means for processing signals from these probes, and means for adjusting the depth of the compacting tool based on the results of this signal processing.

BRIEF DESCRIPTION OF THE SEVERAL VIEWS OF THE DRAWING

Other features and advantages of the invention will become apparent from the following description given by way of example with reference to the attached Figures which represent.

DETAILED DESCRIPTION OF THE INVENTION

Figure 1:
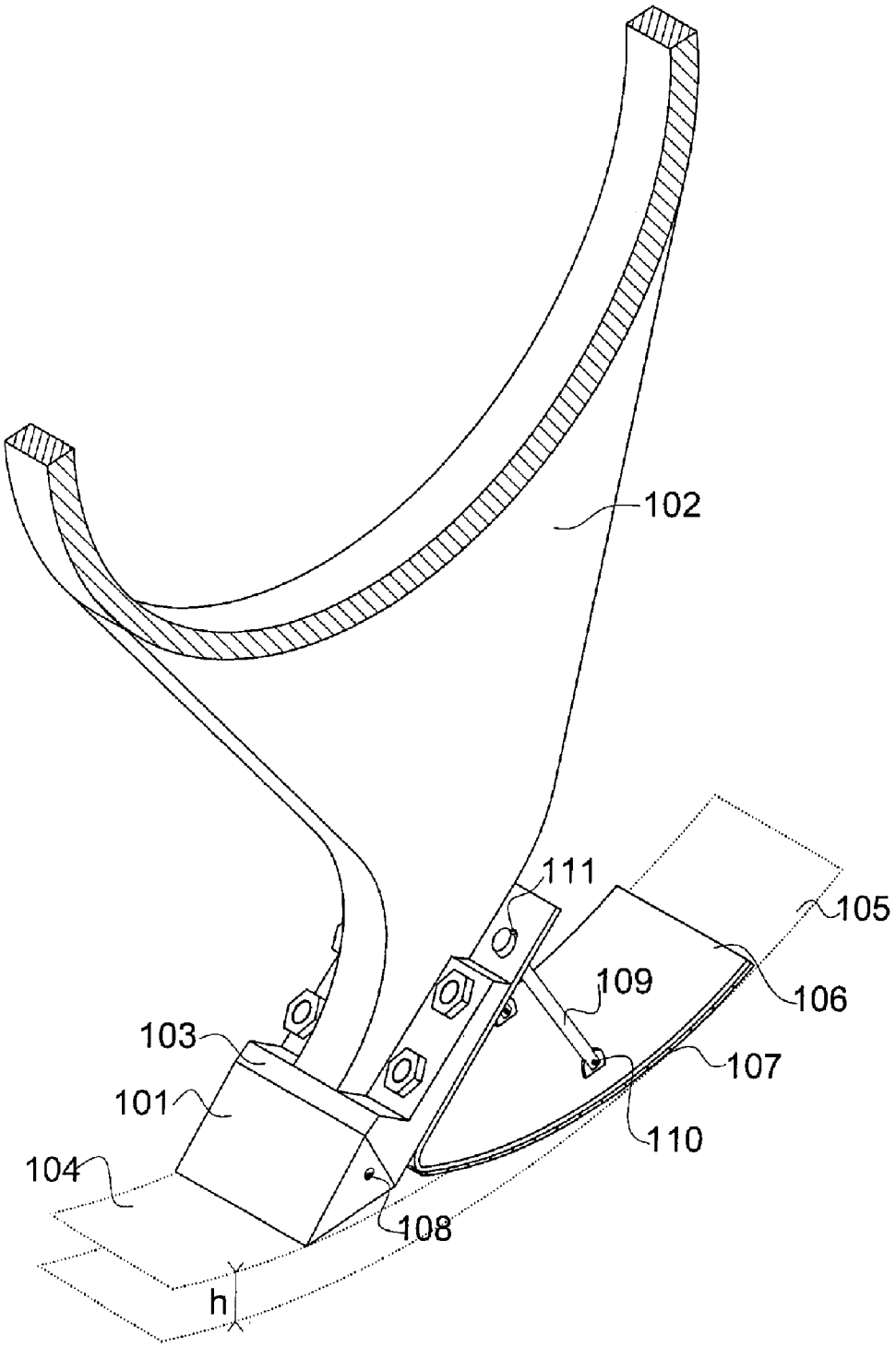
FIG. 1 is a perspective view of an embodiment of a tool according to the invention, limited to a tooth of a relatively small width.

The principle of soil compaction according to the invention is that, in a first stage, a soil compacting device is inserted in the soil at a specified depth H, the device being carried by a construction machine. This device includes at least one wedge-shaped tool, which has a convex surface, tilted downward from front to back, with a convexity directed toward the soil depth in a working position of the tool, that is in a position where it is driven into the soil, parallel to the soil, between a leading edge and a heel located below the surface generated by the leading edge upon displacement of the tool parallel to the soil. In a second stage, this device is advanced while keeping it at the specified depth under the surface, which allows to deform the soil on a height h equal to the difference in height between the front and the rear of the wedge. This difference, which is the offset between the trajectories followed by the leading edge and the heel respectively, is also called the eccentricity of the tool.

The convex underside of the tool works by compression, and thus the soil can be compacted to a depth greater than the depth where the methods of compaction from above the soil become ineffective.

Compaction is obtained by the imprint of the tool into the soil, caused by the movement of the tool carried by an equipment. The depth of the imprint is equal to the eccentricity of the tool, that is to say the height difference between the leading edge and the heel of the base plate. It determines the amount of materials brought into the soil just below. This height h must be related to the intake that the soil can accept without causing disruption in view of its condition. The thickness of the compacted layer corresponds to the level difference between the upper (compacted) part and the lower part which reaches the prescribed compactness level of the layer bottom.

The energy used for the compaction by this method is not constant. It varies significantly, depending on the efforts required to overcome the reaction of the soil which undergoes the deformation imposed by the tool. It may be small in the case of very bulked soil with a tool with a low eccentricity. On the contrary, in case of a too large eccentricity, the energy may be too large with respect to what the soil can accept without causing failure.

Therefore, the effectiveness of the compacting device depends on the choice of the eccentricity of the tool and of the operating procedure.

To allow some variation in order to allow a certain range, FIG. 6, which will be described in detail below, shows a device with a constant profile.

It results from this that within the scope of the invention, many forms of tools may be used, in particular tools where the eccentricity h is constant, others where the eccentricity can vary by setting, or still many others where the eccentricity may vary by rotating the base plate made of a flexible blade or a rigid base plate articulated with a compression spring, or also combined tools with rollers to reduce the friction forces.

As part of the invention, we will also describe the applications based on compacting teeth mounted on a frame with a single movement of translation, as well as teeth mounted on the stars of a rotor.

Still as part of the invention, we will also describe the applications of the invention, given the possibilities for compaction, under railways for shaping the support of the ballast layer, which also allows to treat "in situ" the soil located below the ballast of the railway track, as well as for doing foundation layers.

The tool shown in FIG. 1 is, for clarity of presentation, a unique tool with a relatively small width of a device according to invention. If this tool can be used alone to treat the soil on a small width, several tools will be used to treat the soil on the necessary width, corresponding for example to a running path of a road. This set of teeth will be fixed on a frame, or a rotor, not shown in the Figure, with the teeth arranged either in staggered rows on several rows of the same frame, or on the stars (or branches) of a rotor, with at least one compacting device on each star that is replacing a mixing tooth.

This tool is formed, in this example, by a wedge-shaped tooth 101 whose leading edge is directed forward, and which is attached to an intermediate part 103, itself welded to a vertical post 102 of the frame or at the end of the branch of a rotor star. The plate of the part 103 serves as a common base for all types of compacting tools. The tooth 101 is on top of the intermediate part 103, on which it is attached by a key 108 which allows to replace it easily and inexpensively when worn. The frame 102 allows to push the tooth 101 under the surface of the soil at a depth such that the upper layer of the soil thus removed can be treated from the surface by conventional means, unless it is decided to compact a second layer, above the first layer, at a shallower depth, when forming very thick layers.

This upper layer, of height H, not shown in the Figure, is therefore separated from the virtual surface 104 which separates the two layers, and slides on the upper surface of the tooth 101, separates into two parts around the frame 102 and finally falls at the rear of the device on the virtual surface 105 which corresponds to the virtual surface 104 which has gone down to a depth h under the effect of the compacting treatment. The underside of the tooth 101 is slightly tilted upward from front to rear to remove this face from the surface 104 to avoid undesired effects, due for example to the rubbing of this face on the surface 104.

The compaction, object of the invention, is achieved in the example of implementation described herein, by a blade 106 having a curved shape reproducing the curve of settlement under the repeated effect of the passes of a compactor operating from the surface, whose concavity is directed upward. This blade may be thin and flexible or thick and rigid. The profile of this blade is designed such that its front portion is located substantially at the rear of the tooth 101 so that, during the forward movement of the device, the bottom surface of the blade 106 gradually comes tangent to the surface 104, which is no more virtual here since it has been removed by the tooth, and then gradually presses on this surface to compact the soil so that the surface 104 comes into contact with the surface 105. The height h corresponding to the difference between the surfaces 104 and 105, is determined so that the lower layers below this surface 106 are compacted to the desired level.

However, if a single pass does not allow to achieve the desired degree of compaction, the equipment will be passed again the number of times that is necessary, taking into account what may be accepted by the soil before failure. To avoid a premature wear of the blade 106, for example, it may be covered on its frictional face by wear blades 107 arranged against each other perpendicular to the direction of motion of the device. These wear blades will be attached by any known means, such as welding points.

The desired eccentricity is obtained by the profile of the blade.

In a first case, where the blade is flexible, a permanent state of compression may be maintained using rods 109, in order to limit the bending of the blade and thereby its eccentricity. These rods will be maintained for example by means of eyelets 110 attached perpendicularly to the inside face of this blade 106, substantially at the lowest level of the blade, and allowing them to slide to the other end by passing through oblong holes 111 located at the upper portion of the blade 106. Thus the eccentricity of the blade varies freely between two values, depending on the soil reaction. The eccentricity is maximum when the head of the rods is abutting against the outer face of the upper portion of the blade, and is minimal, or even equal to zero, when the bended blade is fully contained within the surface 104. This allows to compact with the maximum energy that the soil can accept before failure. The selection of the suitable tool is made in advance, based on laboratory shear tests.

In a second case, where the blade is rigid, a curved shape will be given to the blade, corresponding to the desired average eccentricity, and it will possibly be fixed up with means similar to the members 109 to 111, but firmly blocked. It can also be attached to its front end with a transverse joint and held with a compression spring, not shown in the Figure.

Figure 2:
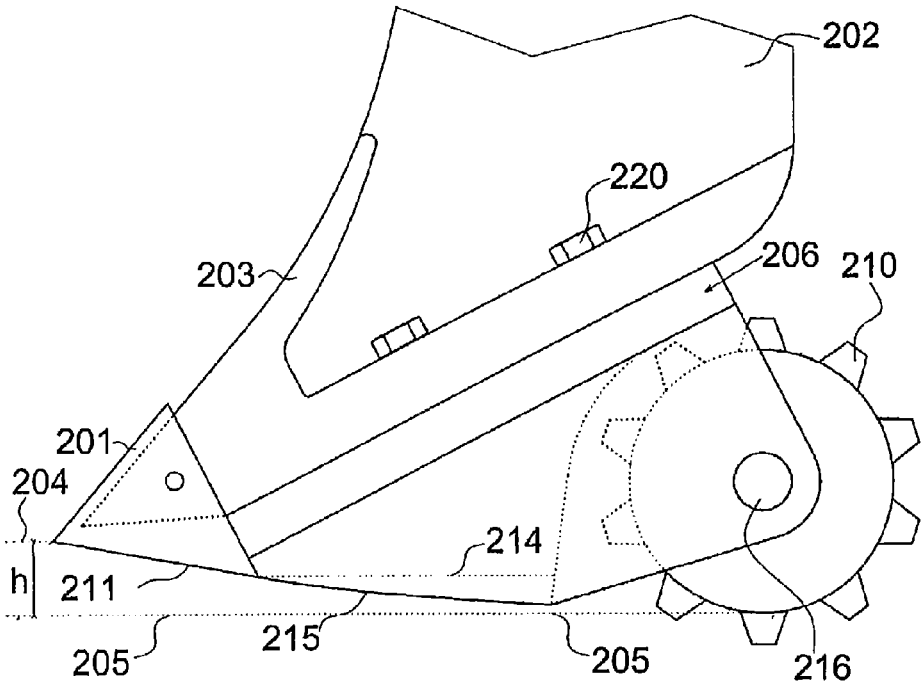
FIG. 2 is a side view of an alternative embodiment, comprising a large roller instead of a blade.

In the embodiment of FIG. 2, there is a wedge 201, similar to the wedge 101, attached to a vertical post or to a rotor branch 202 by means of an intermediate part 203 which serves as a base for all the tools. The upper layer, again not shown in the Figure, is separated by the wedge 201 from the virtual surface 204 and is subjected to the same treatment as in the previous example. However, in this case, the wedge 201 is tilted downward so that its lower face 211 comes to press the surface 204 to achieve a first compaction that generates a real surface 214. Part 206, attached by bolts 220 to the plate of the base 203, is formed at the front by a short length base plate 215 and at the rear by a large cylinder which can be smooth or toothed, or be provided with sheep's foot rollers 210. This cylinder is tangent to the extension of the profile of the base plate. The cylinder rotates freely about an axis 216 retained by the sides of the part 206. In contact with the soil, the cylinder rolls and compacts the soil with minimal resistance. The level of the real surface 214 is lowered to the desired level 205. As in the first embodiment, the surface 205 is covered at the rear of these second compacting means by the cuttings from the stripping of the upper layer by the wedge 201, which cuttings are treated as above.

Figure 3:
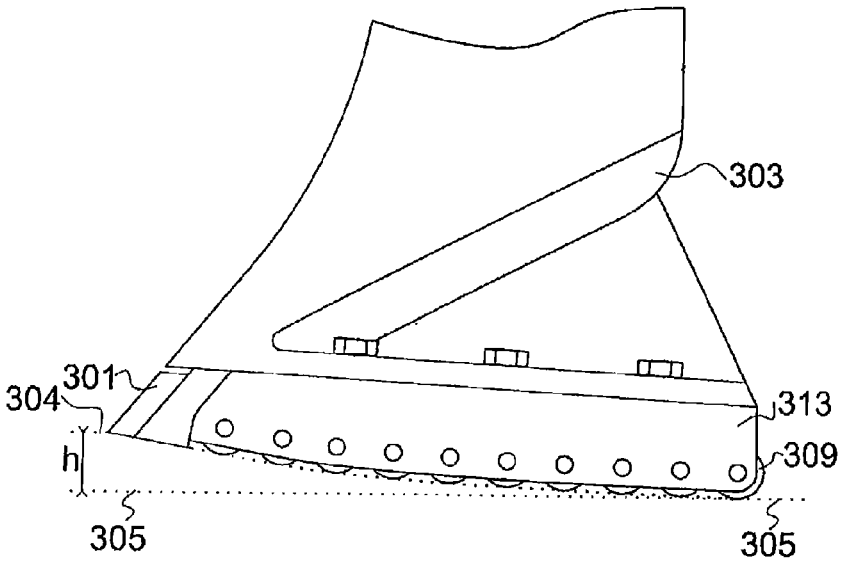
FIG. 3 is a side view of an alternative embodiment, comprising a row of small diameter rollers.
Figure 4:
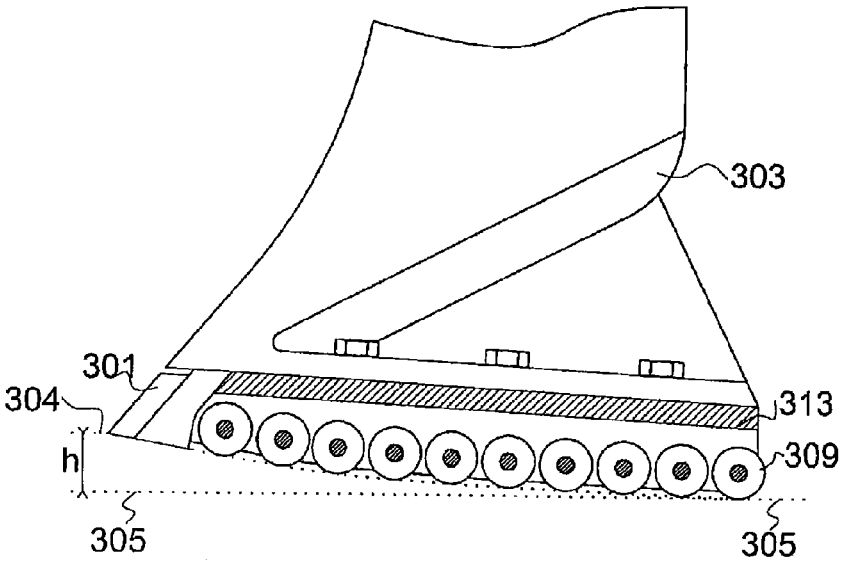
FIG. 4 is a sectional view of the embodiment of FIG. 3.

In a third embodiment, shown in FIGS. 3 and 4, the stripping member is reduced to a simple wear plate 301 particularly resistant, for example in tungsten carbide, attached to an intermediate part 303 by welding or possibly by removable means. This intermediate part acts, as above, as a common support to the blade 301 and to the members described below. The upper layer of the soil, not shown, is treated as in the two previous embodiments. The compaction of the virtual surface 304, allowing to bring this surface 304 back at the desired level of the surface 305 by a compacting of a height h, is obtained in this embodiment by a set of small rollers 309 of small diameter. These rollers are arranged substantially next to each other, parallel to the surface of the soil and perpendicular to the direction of motion of the device. They are attached to another intermediate part 313 which has in this embodiment, downwardly, substantially a U shape with two vertical wings on the sides and defining the two side faces of the device. Their vertical position is defined such that the highest roller is slightly lower than the leading tip of the blade 301, the second roller being slightly lower than the first, and so on. In this way, the last roller will be at the level of the surface 305 and will terminate the desired compaction of the lower layer of the soil.

Figure 5:
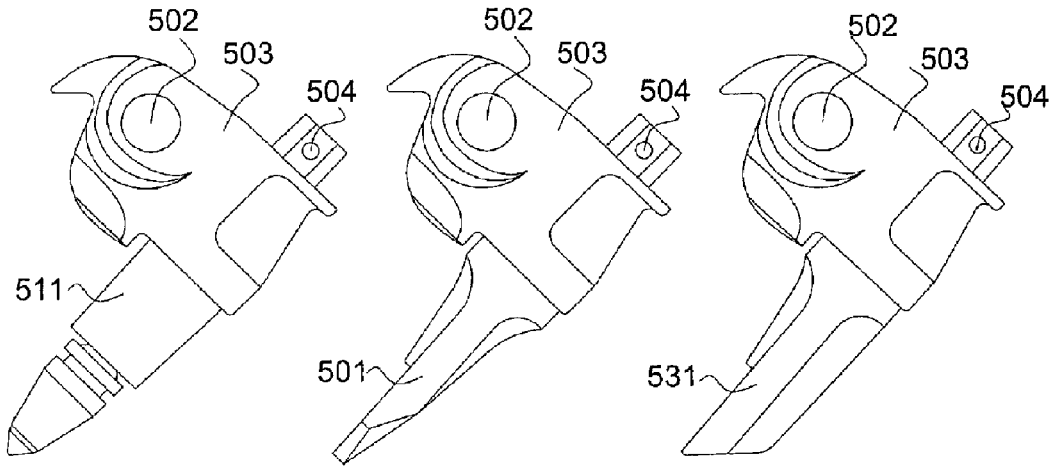
FIG. 5 is a side view of a set of known members.

FIG. 5 shows known members which can be used in a fourth embodiment.

These members include an intermediate part 503 which can be mounted on any support, such as for example a branch of a star 522, through a transverse hole 502 and a bolt not shown. It also includes a longitudinal hole, not visible in the Figure, to receive soil milling tools, such as a pick 511 or a tooth 501/531, which are maintained by a key 504. It is to be noted that the pick 511 and the tooth 531 are particularly reinforced as compared to the standard tooth 501.

Figure 6:
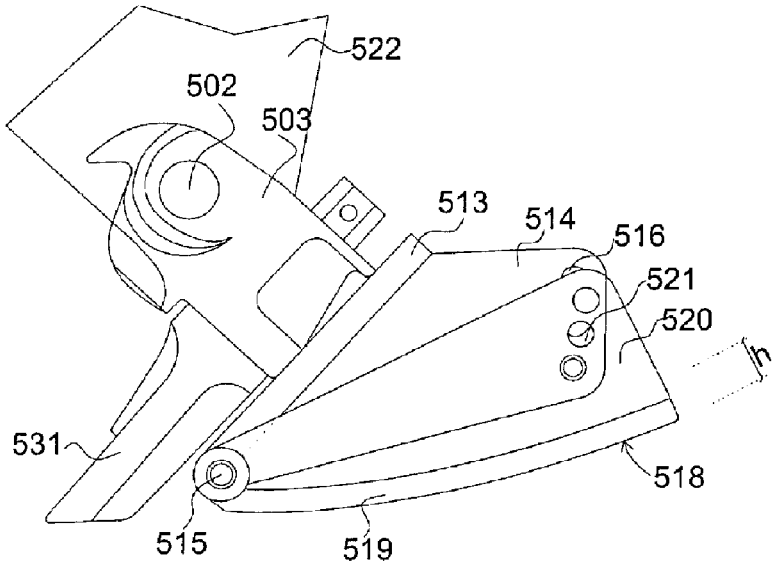
FIG. 6 is a side view of another embodiment, using members of FIG. 5.

A fourth embodiment, shown according to a first example in FIG. 6, comprises an intermediate part as described above, completed by a flat part 513 attached, for example by welding, on the lower end of the part 503 to obtain an intermediate part within the meaning of the invention.

This intermediate part is fixed by its hole 502 to a vertical post 522 of a frame, or to the end of a branch of a star. It is provided for example with a pick 511 or a tooth 531 of the same type as the above-mentioned tooth 501, but particularly reinforced as compared to the teeth used in the prior art. This intermediate part has a vertical central portion 514 comprising a first U-shaped profile turned downward, or two sides of relatively small width. This profile has a hole 515 at the front for engagement of a pin and, on its rear, three holes 516 spaced in the height direction.

The compacting part 518 includes a blade 519 of a curved shape whose concavity is directed upward, this blade reproducing the curve of settlement under the repeated effect of the passages of a compactor acting from the surface, and of two vertical posts or walls 520 forming a second facing U-shaped profile directed upward, fitting in the part 514 from the outside or inside or astride. It also comprises a hole 515 at the front and at its rear three holes 521 spaced in the height direction.

To attach this compacting part on the intermediate part, the part 520 is fitted in the part 514, by aligning the holes 515. Then, the parts are maintained together using a bolt or a pin going through both holes and moderately tightened in order to rotate freely and without friction the part 520 relative to the part 514. The holes 516 and 521 on each of the parts are spaced so that when the part 518 is rotated, only one of the holes 521 is facing only one of the holes 516 of the other part 520, as shown at 521. This provides three positions of the parts relative to one another. In this way three possibilities for adjusting the height of the blade 519 relative to the part 513 and the wedge 501 are obtained. These three settings correspond to three heights of compaction and three values of h.

Figure 7:
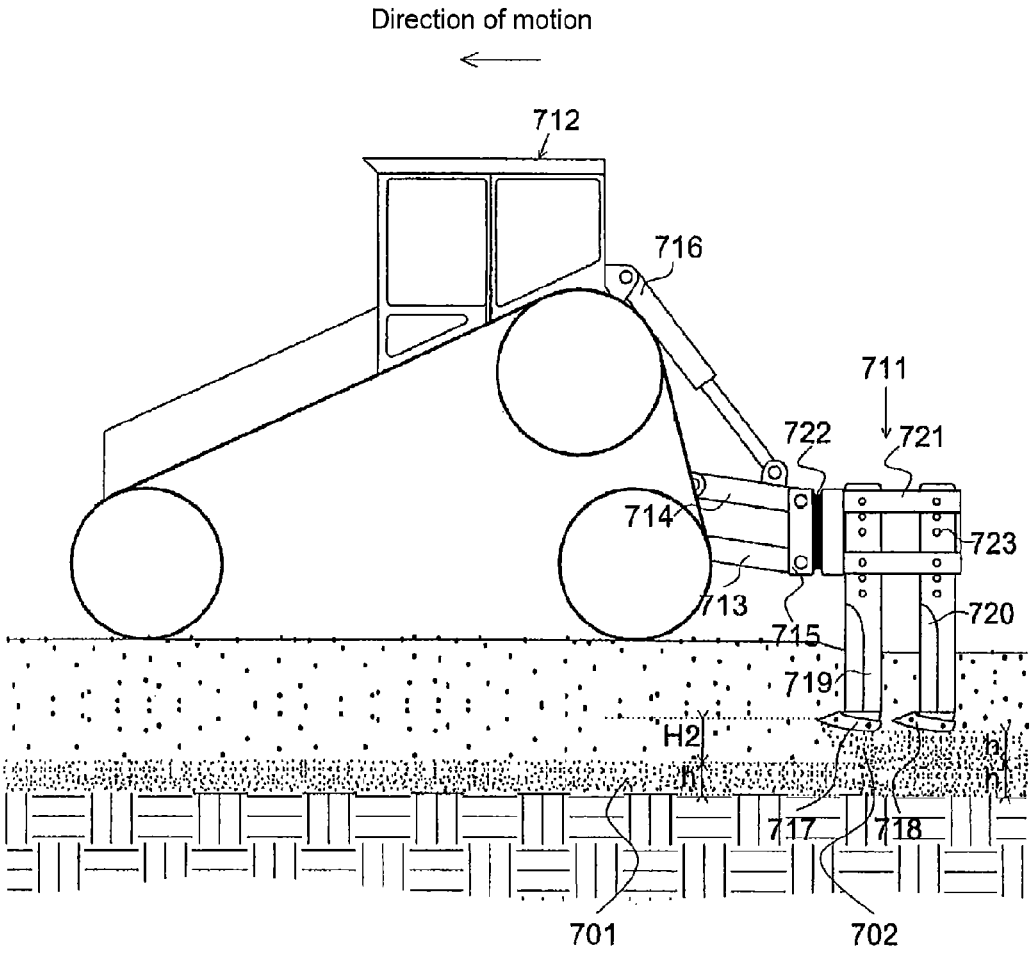
FIG. 7 is a side view of a tractor towing a first application of a device according to the invention.

A first application, shown in FIG. 7, is to mount, for example on a crawler tractor 712, a device 711 according to the invention. This device is preferably attached to the rear of the tractor for stability issues of the whole assembly. This attachment is done by using two longitudinal arms 713 and 714 and a vertical part 715 forming a deformable parallelogram which will allow, using a cylinder 716 attached between the rear of the tractor and the arm 714, to set the depth of the device into the soil.

The whole assembly is shown in FIG. 7 during a second pass of the device. The first pass allowed to compact the soil in depth to obtain a first layer 701 compacted on a height h. For the second pass, the device is lifted, using the cylinder 716, of the height H2 to compact a second layer 702 resting on the first layer 701. This layer 702 will be compacted on a height h. The difference H2−h is equal to the difference between the leading edge of the tooth and the lower portion of the two tools 717 and 718 described below.

The device consists of two rows of tools 717 and 718 according to the invention, such as those described above. They are preferably arranged in staggered rows and supported by supports 719 and 720. These supports are themselves attached to a rigid frame 721, which is itself attached directly to the vertical part 715. The attachment of the supports 719 and 720 to the frame 721 is adjustable step by step, using holes 723, to complement the action of the cylinder 716.

Alternatively, a vibratory movement represented by the arrow 723 and obtained through a known mechanism not shown can be communicated to the tools/supports/frame assembly. Only in this case, elastic means 722 of the type "silentbloc" (vibration damping rubber) are useful to prevent the transmission of vibrations to the tractor. This reduces to some extent the tensile force and increases the efficiency of compaction in some soils.

In another alternative, the supports 719 and 720, as well as the compacting teeth 717 and 718, can be hollow so as to allow the passage of pressurized powder binders and their dispersion above the compacted layer. A rough dispersion of the binder with this upper soil is done using a small rotor with a diameter substantially equal to H2, not shown in the Figure. This improves the mechanical properties of the upper layer before it is compacted with the same means.

Figure 8:
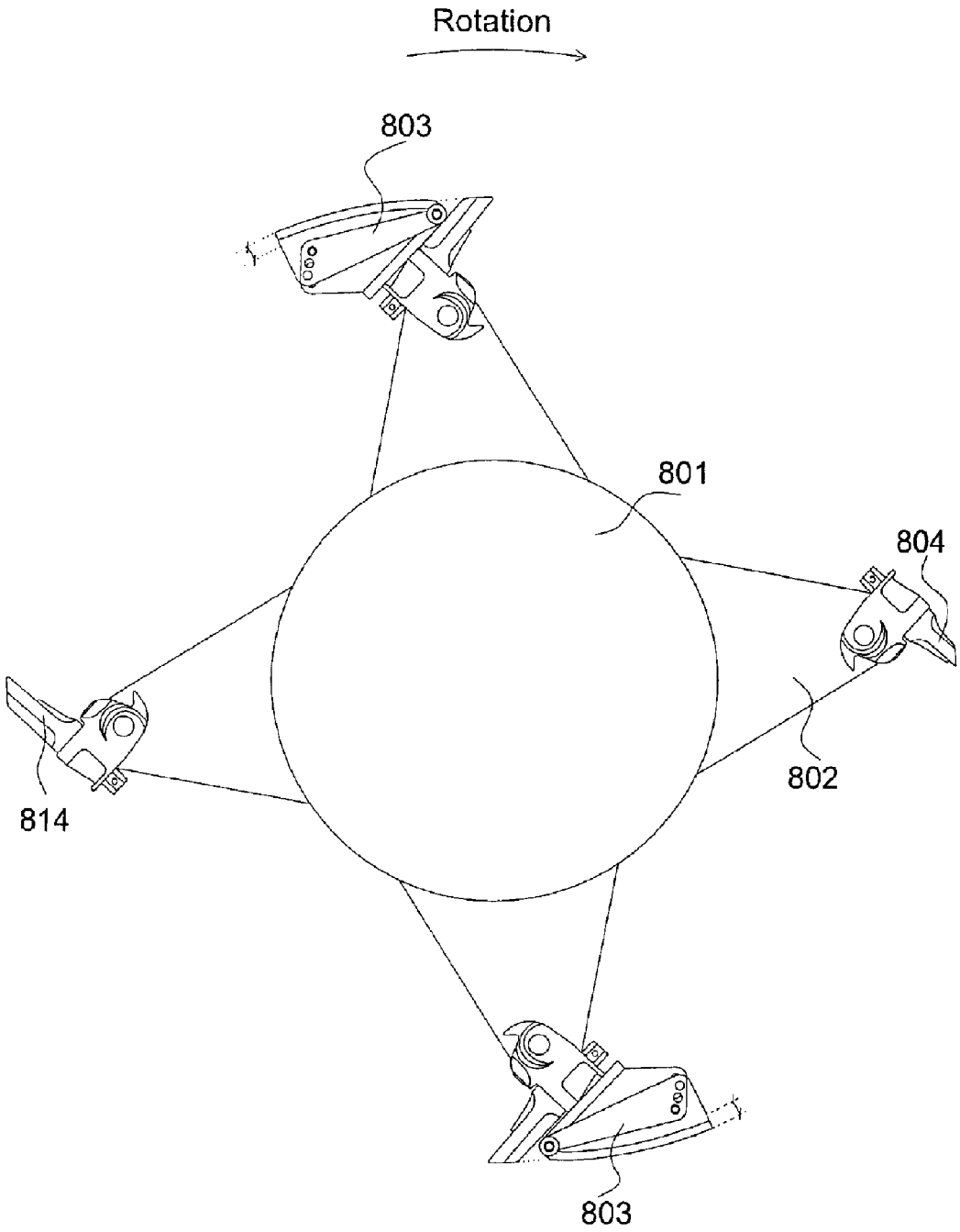
FIG. 8 is a side view of a rotor equipped with members according to FIGS. 5 and 6 to form a second application of a device according to the invention.

A second application, shown in FIG. 8, is to mount tools according to the invention on the branches of a rotor 801 equipped with stars 802. In this example, only one star is shown, and it has four arms. Two of these diametrically opposite arms support known members 804 and 814 such as those shown in FIG. 5, and the two other diametrically opposite arms support members 803 according to the invention, such as those shown in FIG. 6. The wear of the tooth 804 and the good behavior of the tooth 814 are to be noted, the latter being reinforced according to the invention. Therefore, the worn tooth 804 has to be replaced by a reinforced tooth of the type of the tooth 814.

This application relates in particular to the device known as a "stabilizer". It then requires the replacement on each star of at least one tooth (preferably two) by a compacting tool according to the invention, to allow the compaction of a band. It also requires changing the other teeth by teeth doing the same work, but reinforced according to the invention, for example by thickening or by a tungsten carbide pellet, to have the same wear as those of the compacting tools.

This allows to compact the support soil and to mix the layer at the same time. In this second application, it is useful to arrange the rotor inside a resistant and thick protective hood, which both provides protection against projections and forms a chamber for the mixing. The rotor/hood assembly is attached to a carrier machine, either at the front or at the middle or at the back thereof, as shown respectively in FIGS. 9 to 10. In these embodiments, the carrier machines are equipped with large diameter tires.

Figure 9:
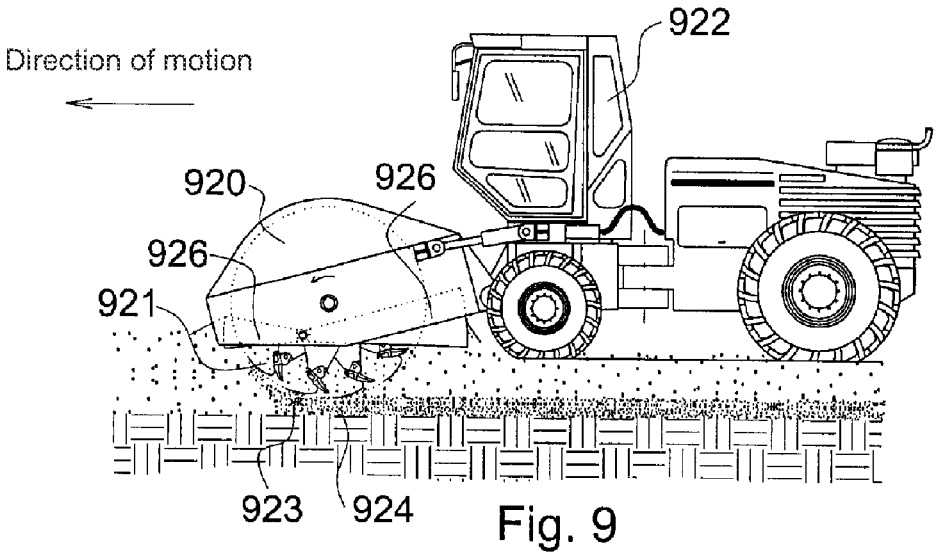
FIGS. 9-11 are side views of three carrier vehicles equipped with a rotor such as that of FIG. 8.

In the example of FIG. 9, where the hood 920 and the rotor 921 are attached at the front of a construction machine 922, the means for driving the rotor in rotation are known and not shown, in this embodiment as well as in all other Figures, for an easier reading of the Figures.

This second application allows to compact the treated layer from bottom to top by successive passes of the compacting machine.

This is the case in FIG. 9, wherein the hood 920 and the rotor 921 form a dedicated tool for this application. In this embodiment, the rotor rotates in the direction of motion. This allows the soil 923 in the layer bottom to come in abutment against an already compacted soil 924. If the rotor rotates in the opposite direction, the compacted soil would be again pushed forward toward an uncompacted soil, to come in abutment against an already compacted soil 924. By doing so, it is possible to obtain a higher rate of compactness with a reduced risk of cracking. If the rotor was to rotate in the opposite direction, the compacted soil would be again pushed forward toward an uncompacted soil, which would limit the rate of compaction and result in a risk of cracking.

Figure 10:
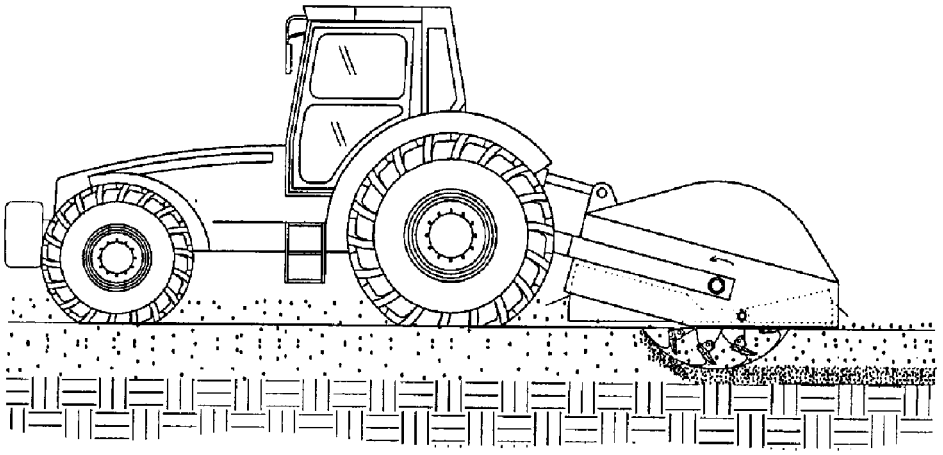
Figure 11:
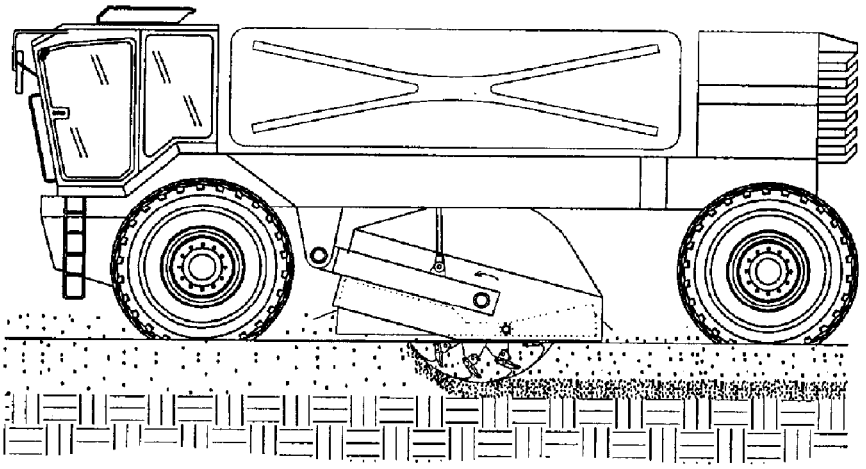

The hood equipped with its rotor can be attached either at the front as shown in FIG. 9, similarly to a "vibrating ball" compactor, or at the center as in FIG. 10, similarly to a stabilizer, or at the rear of a powerful tractor, as in FIG. 11. It can be noted that in FIG. 9, the hood was provided with a screen 926 in materials such as sheet metal, to avoid projection of debris and especially of dust.

The advantage of having a specific hood/rotor equipment mounted for example at the rear of an agricultural tractor, or of a carrier machine designed for this purpose, is to reduce operating and construction costs by keeping only the specifications required for the compaction.

In this case, the rotor may be attached relative to the hood with protective housings at the front and at the rear thereof, such as the members 926. These housings may be lowered by rotation, for example. The rotor diameter can then be smaller. Moreover, this equipment may have all the functions to automate the production.

Moreover, it is possible to add to the equipment a water tank and a spray bar located in the hood, to supply to the materials to be compacted further water inside the hood itself, if necessary.

Figure 12:
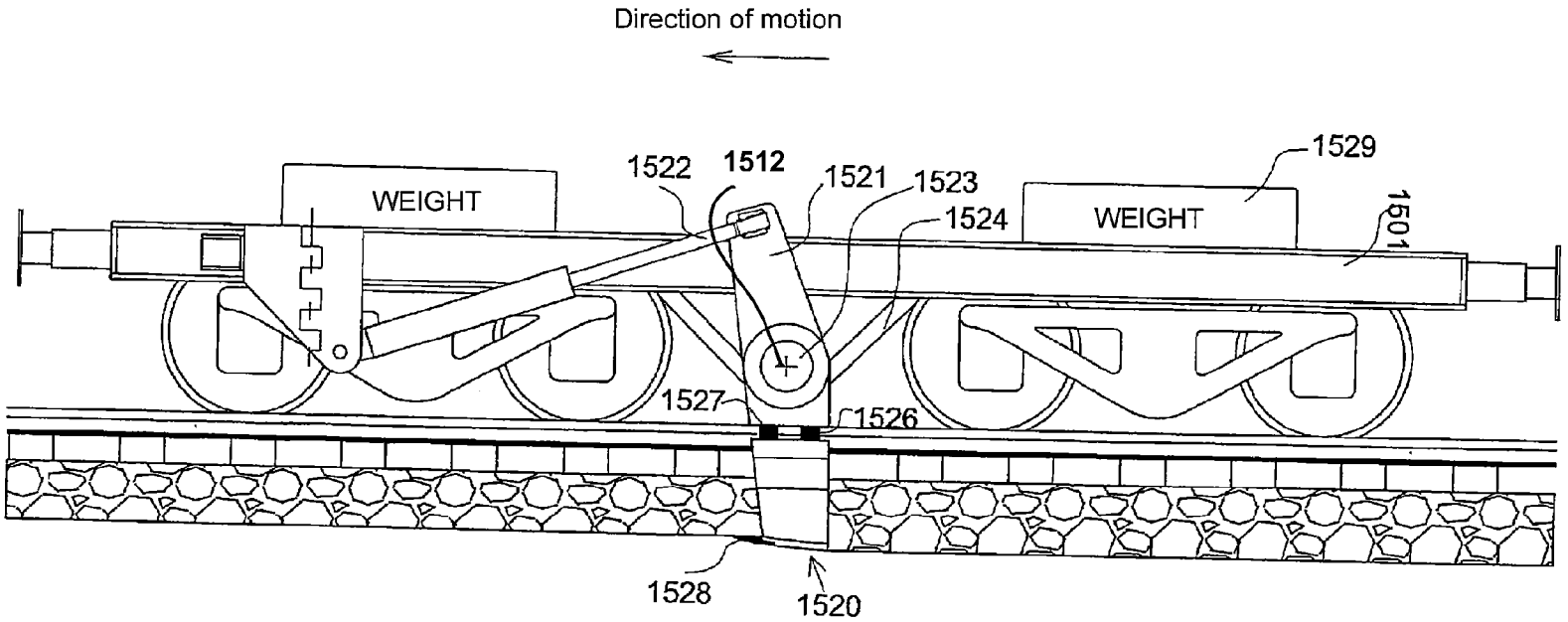
FIG. 12 is a side view of a workshop railcar to carry out a third application of the invention.

A third application, relatively more complex, consists in applying the method according to the invention to the reconstruction of railway tracks, as shown in FIG. 12.

It is to be reminded that the ballast acts as a spring and damper to communicate to the soil the forces due to the passage of trains and prevents the ties from going gradually deeper into the soil.

However, as trains pass, the ballast pebbles fragment by attrition, resulting in a settlement of the ballast and therefore a degradation of its performances.

To repair this, a special train is used, comprising railcars provided with a chassis 1501 and bogies 1502, which allow to raise the railway track, to screen the ballast, to strengthen it with new good-sized pebbles and to proceed to the setting of the railway track.

The invention contemplates using the above-described method, without having to remove the track, to enable to carry out works such as setting and compaction of the structure under the ballast, the building of a foundation layer by treatment in situ, or the building of a foundation layer with addition of materials, sand-gravel aggregate, cement-bound graded aggregate, etc., after completing the earthwork required for the casing. These works are then conducted "in situ" under the ballast, without having to remove the rails and before the operations of treatment of the ballast and setting of the railway tracks.

For this, a device that allows to implement the method according to the invention is used. This device could for example be one of those described above, or any other device corresponding to the definition of the invention. In the case illustrated in FIG. 12, which represents a repair railcar comprising a frame 1501 and bogies 1502, this railcar is equipped with such an device 1520 of the invention. It has a blade 1528 whose cutting edge is directed toward the direction of motion of the railcar, that is to say toward the left in the Figure. This blade is inclined downward from front to rear in order to compact the soil according to the invention. The blade is as thin as possible in order to minimize the settlement of the ballast against the ties and its uplift between these ties. The upper portion of the blade is horizontal or slightly tilted to limit the friction forces when in contact with the ballast.

Figure 18:
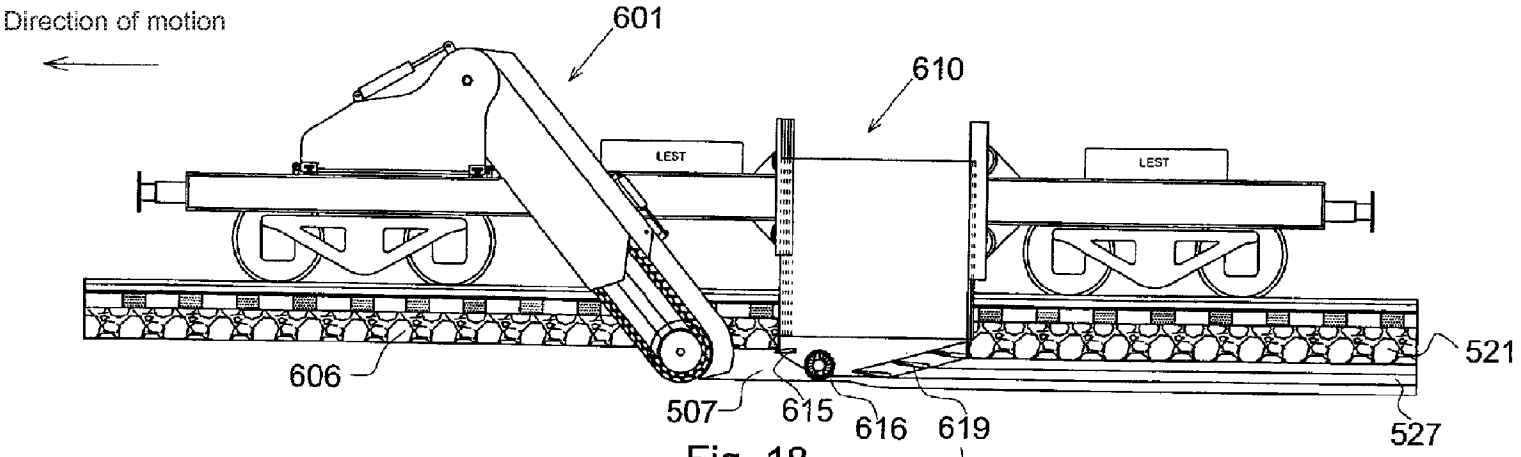
FIGS. 18 and 19 are side and top views of a repair railcar to carry out a second embodiment of the third application of the invention.

The blade is attached, in a manner described below, at the lower ends of two arms 1521. These two arms are extended upward and connected at their upper ends by a transverse cylinder, not shown. The lower portions of these two arms, to which the blade 1528 of the invention is attached, are formed by two narrow and tapered thin solid blades able to make their trace into the ballast on each side of the track beyond the ties.

Where appropriate, it could be useful to attach at the front of the railcar two ladder ditcher known, not shown in this Figure but shown in FIG. 18. They allow to make two side trenches at the boundary of the ballast to allow the passage of the lower ends of the arms in order to position them in the soil at the height corresponding to the layer to be treated. These trenches also allow, if necessary, to improve drainage of the railway track.

The transverse cylinder pulls on the upper ends of the two arms 1521, so that when the blade 1528 is active, it exerts a tension for tensioning the blade so as to reduce the compressive stresses and "ultimately" to reduce its thickness.

In the Figure, only the cylinder on the left side relative to the motion may be seen, because it hides the one on the right side. This is also true for all the mechanism for attaching and adjusting the position of the compacting device.

These arms are rotatively attached to the ends of a shaft 1523. A longitudinal cylinder 1522 allows to perform this rotation.

This shaft is itself attached to the frame 1501 by means of wishbones 1524 which maintain the shaft above the rails, parallel to the axis of the wheels and substantially at the same height as the latter relative to the level of the railway tracks. This shaft 1523 extends on both sides of the railcar to maintain the arms 1521 at the level where the width of the ballast stops. The compacting device 1520 can thus be kept under the ballast at the interface between the ballast and the soil.

The maintenance at the desired depth is done by acting on a cylinder, for example using a servomechanism.

The arms 1521, cylinders 1522 and compacting device 1520 assembly is sized such that this device is positioned at the correct angle so that the blade 1528 actually has its compacting effect of the soil under the ballast, for average sizes of the thickness of the ballast/ties/track assembly.

Apart from this average position, the adjustment by pivoting around the axis 1512 causes a variation in the positioning angle of the blade 1528. To compensate for this variation, which plays a large part on the settlement effect, in this embodiment, for example, two small cylinders 1526 and 1527 are used for modifying slightly the orientation of the lower portion of the arm 1521 and therefore the orientation of the device 1520.

If necessary, a servomechanism may be used to maintain at the proper height and with a good inclination the compacting device 1520 by acting on the cylinders 1522 and 1526/1527.

The forces exerting on the compacting device 1520 tend to lift it, as well as the rest of the railcar, in a rather important way. It is thus necessary to dispose on the chassis of the railcar weights 1529, whose number and weight will be determined experimentally.

It is clear that the assembly thus represented is in the operating position. To start the work, it will be necessary to carry out earthwork to position the compacting device 1520.

For this, the blade 1528 is detached from the posts 1521. The assembly is done during the approaching motion of the railcar by the engagement of lugs of the posts 1521, not shown here, in recesses integral with the blade. Locks not shown block the whole assembly. This assembly and disassembly operation has to be done again from time to time to change the blade 1528, when the degree of wear of the blade will be too important and between each daily interruption of the site. The blade then remains in place.

Figure 13:
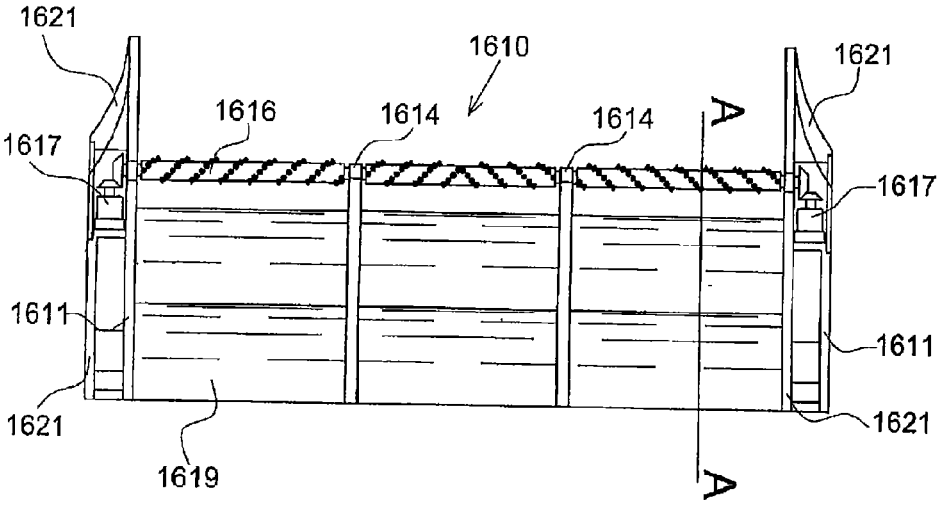
FIG. 13 is a top view of a rigid frame provided with means to carry out a first embodiment of this third application.
Figure 16:
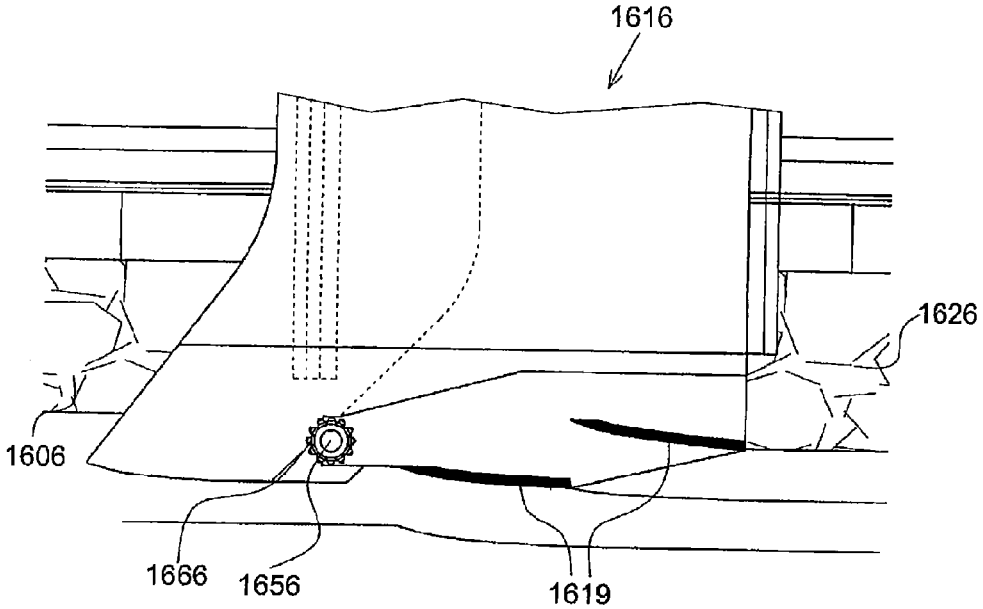
FIG. 16 is a partial and sectional view of FIG. 15.
Figure 14:
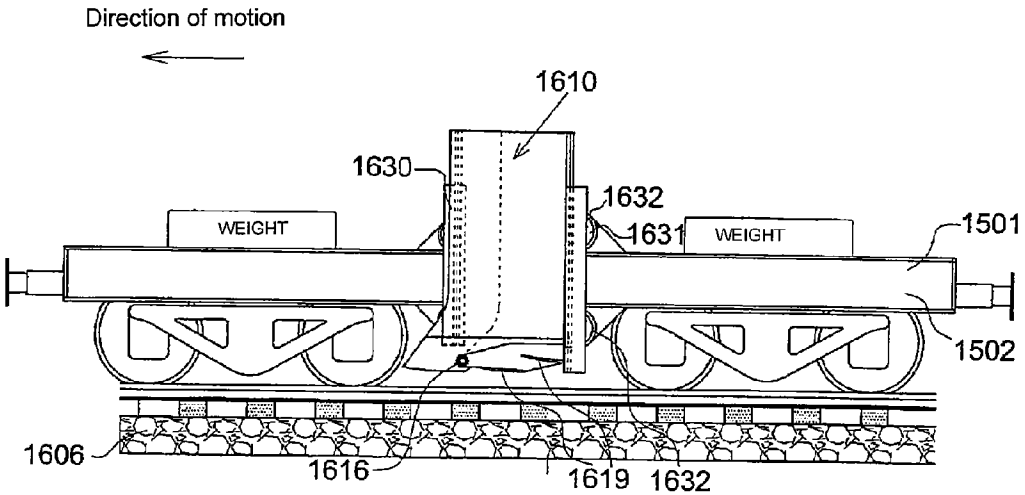
FIGS. 14 and 15 are side views of a repair railcar equipped with said rigid frame, in position of transport and travel, respectively.
Figure 15:
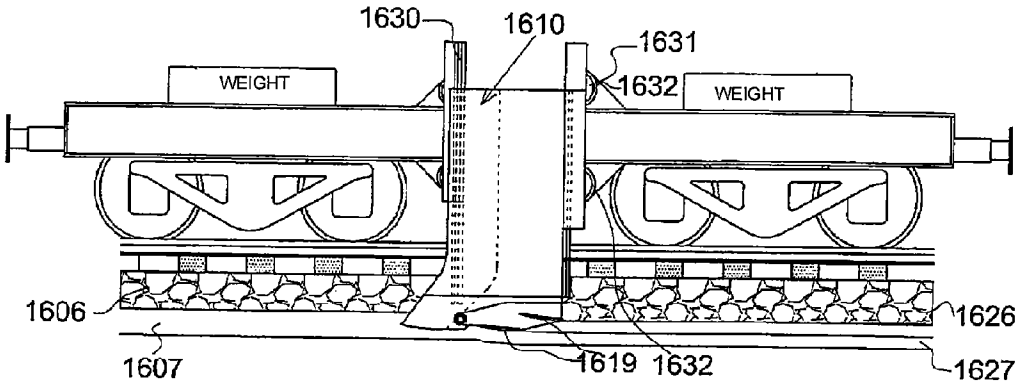
Figure 17:
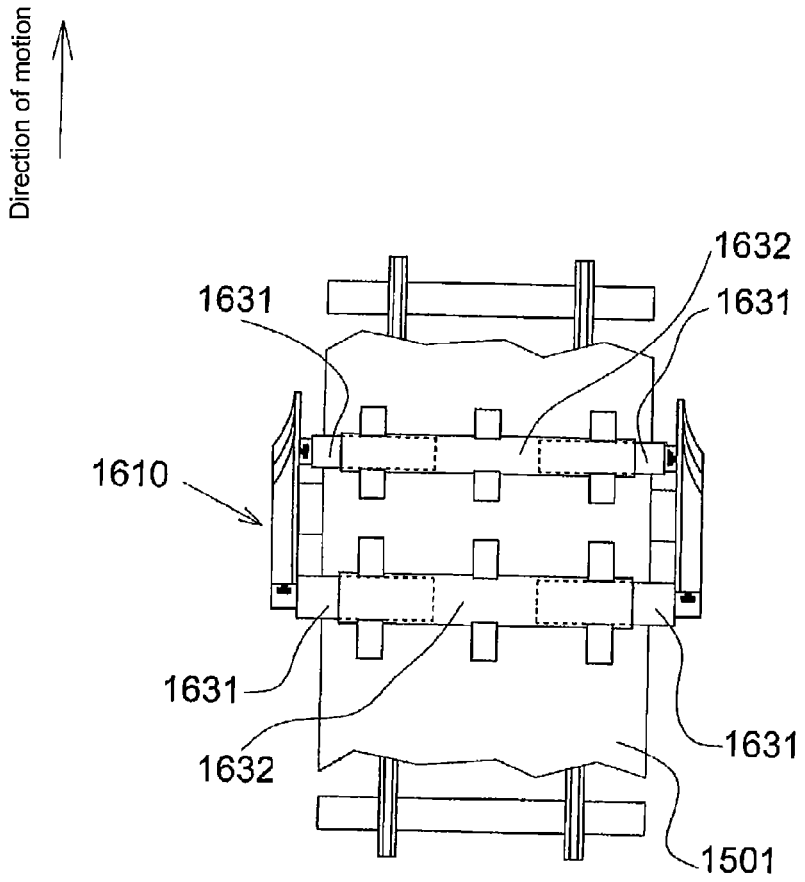
FIG. 17 is a schematic view of a device allowing to move the frame transversely with respect to the railcar.

According to another embodiment of the invention, useful for example to compact a thicker layer, a rigid frame 1610 can be used, such as the one shown in FIG. 13, and attached on a railcar shown in FIGS. 14 and 15. FIG. 16 shows in turn a partial and enlarged view of FIG. 15, limited to the active portion of the frame 1610. Finally, FIG. 17 schematically shows a device for moving the frame transversely relatively to the railcar.

In FIG. 14, the frame 1610 is in a raised position, for example to move the railcar between two working positions.

In FIG. 15, this frame is lowered in the working position in order to compact the thickness of the soil 1607 situated below the ballast layer 1606.

The displacement of the frame between these two positions is done by sliding along four vertical posts attached to the railcar so as to correspond to the four corners of the frame. The frame is blocked on the posts by known means, for example by means of bolts.

To allow a transverse movement of the frame, in this example, each post is attached to two cylindrical rods 1631 placed respectively above and below the chassis 1501. These rods can slide in hollow cylinders 1632 attached, for example by welding, on the top and bottom of the chassis. Thus, the frame can be offset to the right or to the left, according to the needs on site. Moreover, frames of varying widths can be used, depending on the material available, for example.

This frame includes, for example, two side plates 1611 which are attached together at their lower portion by two blades 1619 of the invention. Stiffeners 1614, and more precisely two stiffeners in the Figure, allow to stiffen the assembly to form a rigid frame which supports, without deforming, the forces that will be applied thereto during compaction.

In another embodiment, the blades are shorter and their length is equal to the distance between a side plate 1611 and the stiffener 1614 closest to it. The centre-to-centre distances between each of these side plates and the nearest stiffener are the same as the centre-to-centre distance between the stiffeners, so that these blades can be arranged in staggered rows.

In this embodiment, on the side plates, on the outside and at a little distance therefrom, two other plates 1621 have been attached, which exhibit at the front a low blade profile in order to push laterally the ballast and to reduce the tensile forces.

In the case illustrated in FIGS. 13 to 16, this frame supports two blades 1619 whose cutting edge is directed in the direction of motion of the railcar, that is to say toward the left in the Figures. These blades are tilted downward from front to rear in order to compact the soil in accordance with the invention. The number of blades is fixed here to process in only one pass the entire layer.

The blades can also be arranged recessed in the height direction and backwards, like the steps of a staircase, at different depths, so as to compact in only one pass a thicker layer. The inclination of the blades is different. It corresponds to the thickness and density of the compacted layer to obtain the same density.

The attachment height and the number of the various blades are set relative to the thickness of the layer 1607 and to the height of the fraction of this layer that can be compacted by each of the blades.

The invention further contemplates, in order to promote the penetration of the blades 1619, to put forward of said blades a mini rotor or a small milling tool 1616.

This milling tool is formed, in this embodiment, by a small diameter shaft 1656 supporting a set of tools 1666, such as picks for example, regularly attached on this shaft. Each pick is arranged in a cylindrical or slightly tapered housing where it is held by a ring. Each housing is extended by a small diameter cylindrical hole opening diametrically on the opposite side of the housing. These holes allow to expel the picks when worn.

The shaft is attached to the side plates and to the ribs 1614 by means of bearings. It is rotated relatively fast as compared to the advance of the railcar by known means such as hydraulic motor reducers 1617, attached in this example within chambers formed by the space between the plates 1611 and 1621, which protects it against friction with earth or with the ballast of the furrows and against the projections of any kind due to the soil treatment.

The advantage of this arrangement lies in the fact that the milling tool disintegrates the interface ballast/soil to separate them in more easily, in order to treat the ballast in one hand and to compact the soil on the other hand.

Having several blades for compacting allows to strengthen the structure of the compacting tool, which is subjected to significant deformation forces, imparting it a greater rigidity. It also allows compacting in only one pass a greater thickness. By doing so, the support platform is of a better quality and yields are increased.

The ballast 1606 is processed by known means, not shown, which sort the pebbles which became too small and which replace them by pebbles of normal size, causing the thickening of the ballast layer 1627 on the back of the soil treating members. Of course, it can be noted from FIGS. 15 and 16, that the upper surface of the thus compacted soil 1607 is lower than the upper surface of the soil 1627, which corresponds to the increase in thickness of this ballast layer, due to treatment thereof.

One can also note the two veins 1627 of the compacted soil, which extend below the thus treated ballast 1626.

Figure 19:
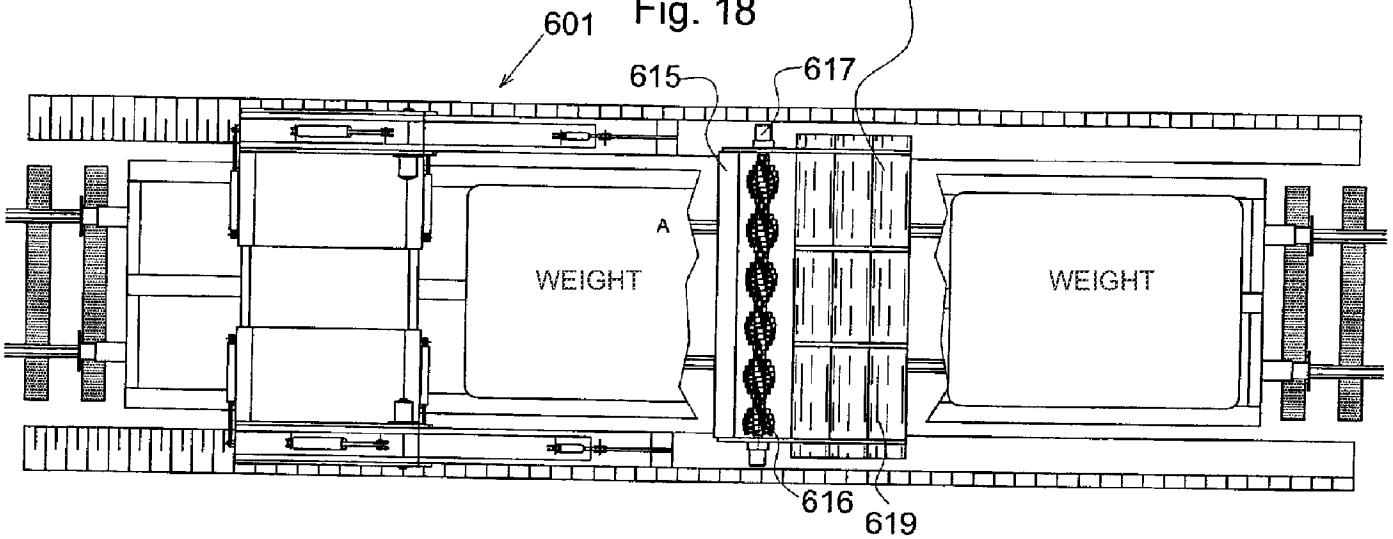

A second embodiment of the previous application, shown in a side view in FIG. 18 and in a top view in FIG. 19, allows to carry out the treatment of the soil in situ.

For this, a railcar very similar to that of FIGS. 14 and 15 is used, and for clarity of the Figures, only the members which are not the same between the two groups of Figures have been listed.

The railcar is therefore provided with a frame 610 which includes devices (here three blades) 619 according to the invention, for simultaneously compacting and processing a layer 507 of the soil beneath the ballast 606, which is processed at the same time by one of the above-described methods, to give a renovated/rebuilt ballast layer 521.

The soil is initially separated from the ballast by a thin and resistant blade 615 placed at the front of the frame.

This thus exposed soil is triturated and bulked on the desired thickness by a large rotor or a milling tool 616. The latter is formed, as is known, by a shaft with members such as picks, chisels, etc.

During this operation, products for improving its physical characteristics, such as a hydraulic binder, are poured on the soil, by known means not shown. The nature and volume of these products are determined in advance by a soil analysis.

The thus spread products are thoroughly mixed with the soil by the action of the milling tool.

The resulting mixture can then be compacted by the devices 619 to obtain a soil 527 with the improved characteristics through both treatment and compaction.

The milling tool 615 is driven by motors 617 which extend on each side of the frame. To let them pass, the invention proposes to provide on each side of the railcar a trench of sufficient size. To do this, slicers 601 of known type are used.

The device according to the invention also enables an automatic control, or feedback control, between the machine parameters and the rate of compactness to be obtained, to provide assistance in the conducting as well as the monitoring and the continuous control of the compacting.

It is to be reminded here that the device according the invention is used to compact a thin layer. This thickness is related with the strain imposed by the profile of the base plate, at the rate of compactness required with a single pass of the equipment.

Under these circumstances, the frictional forces of the base plate in contact with the soil and the pressure exerted by the equipment must be identical all the time. To find these values, depending on the application, carefully chosen parameters, correlated with the exerted frictional forces and pressure, are measured during a test pad, using sensors or probes, for example. Then, during the compacting, it is sufficient to continuously adjust the depth of the compacting tool to match the values of the parameters measured during the compacting, with the reference values defined during the test. The continuous adjustment of the depth can be automated. If the parameters are too low, the thickness of the layer must be reduced.

Otherwise, if the measured parameters are superior to the reference values, to meet the conditions of compacting, the thickness of the layer must be increased.

Proceeding in the same manner, layer by layer, gradually ascending from the base plate of the tool, the required total thickness is obtained, with a rate of compactness that is uniform, substantially constant and independent of the depth.

According to another embodiment of the invention, a continuous and controlled compaction may be obtained by adding to the device a guiding and x, y, z positioning system, with recording.

In the case of the invention, each passage allows to achieve the desired rate of compactness on a layer with reduced thickness, provided that the thickness of the layer is continuously adjusted, since the tool is carried. This can be done by simply making the necessary adjustments based on the response of the soil/equipment assembly. Compacting a thicker layer will require several passages in the same conditions, each time after having raised the tool by the thickness of the previously compacted layer. Ultimately, this allows to obtain a compacted layer of the desired thickness, with a regular and high rate of compactness throughout its entire thickness.

In the case of a compaction with conventional means, the compactor multiplies the number of passages, as long as the measured rigidity of the platform will be sufficient. This procedure does not however mean that one can be sure to obtain the desired rate of compactness at the layer bottom, the gradient of compactness being decreasing.

The proposed automatic control method consists in using the information from the sensors to measure the tensile forces and the mass forces in the case of compaction by displacement, and moreover in using sensors for measuring vibrations or accelerations in the case of compaction by displacement and rotation of the tools, for correlating these measures with the compactness curves obtained in another way, to determine the optimum operating conditions.

Under these circumstances, it is possible to vary by automatic control the depth of the tool so that the "response" always corresponds to the reference determined on the basis of a test pad.

With the advantageous association of a positioning and tool depth measuring device, with recording, the material receives the information necessary for performing a new pass, and this until the layer corresponding to the thickness projected with the prescribed rate of compactness on any height is obtained.

SEQUENCE LISTING

Not Applicable

The invention claimed is:

1. A soil compacting device, comprising:

a frame supporting a heel having a convex surface, from a front to a rear of the device in an advance direction of the device, with a convexity toward soil depth in a working position of the device, the frame including a vertical post, wherein a front wedge-shaped tool is on a front part of the heel, an edge of the wedge-shaped tool forming a leading edge provided at the front of the frame and parallel to a surface of soil, the leading edge having the same width as the heel, the front wedge-shaped tool being disposed closer to the vertical post of the frame than the convex surface of the heel such that a part or the entire convex surface of the heel is configured to be disposed below the surface generated by the leading edge when the tool is advanced parallel to the soil, the heel compacting the soil as the device is advanced, the soil compacting device is configured to compact the soil through forward advancement of the device parallel to the soil, and the heel is formed with a smooth surface.

2. The device according to claim 1, wherein the wedge-shaped tool is a wedge-shaped tooth whose leading edge is facing forward in order to remove upper layers of the soil, said tooth being attached on the frame by an intermediate part acting as a common support for the tooth and for a blade which is also attached at the rear of the tooth and has a curved shape whose concavity is directed toward the vertical post, whose front is at a bottom level of the removed soil and whose lowest portion is at a desired level of compaction for a single pass of the device.

3. The device according to claim 2, wherein the blade acts itself as a spring or is attached at a front end thereof by a transverse joint and is maintained compressed by a spring.

4. The device according to claim 2, wherein said device is attached to an end of two arms rotatable on a horizontal axis perpendicular to the longitudinal axis of said device, the device further comprising means to rotate the arms so as to maintain said device under the level of a ballast of a railway track, and means for tensioning said blade.

5. The device according to claim 1, wherein the wedge-shaped tool is a wedge-shaped tooth whose leading edge is facing forward in order to remove the upper layers of the soil and whose bottom portion is tilted downward with respect to the vertical post to perform a first compaction at an intermediate level, said tooth being attached to a frame by an intermediate part which also supports, at the rear of the tooth, a compacting roller for performing a second compaction to obtain the desired level, said roller being smooth or ridged, or supporting sheep's foot rollers.

6. The device according to claim 1, wherein the device comprises a single wear blade tilted from front to rear to remove the upper layers of the soil, said blade being attached on a frame by means of an intermediate part acting as a common support for the blade and a set of rollers attached to a second intermediate part which in turn is attached to the first part, these rollers being disposed substantially next to each other, parallel to the soil surface and perpendicular to the direction of motion of the device, the first roller of these rollers being further located slightly below the tip of the wear blade in relation to the vertical post, and other rollers being slightly shifted in depth so that the last is at the desired level for the depth of compaction (h).

7. The device according to claim 1, further comprising an intermediate part provided with a known support, which includes a longitudinal hole for receiving soil decompacting tools, wherein a flat part is added on a lower portion of said support, said flat part being attached on a lower end of said support, the front end of the lower portion of the flat part being provided with a first vertical fin with a hole at the front, a rear end of the lower portion of the flat part being provided with three holes spaced in a height direction, the support/flat part assembly forming said intermediate part, and wherein the device further comprises a compacting part provided with a blade having a curved shape whose concavity is directed upward, said blade reproducing a curve of settlement under a repeated effect of the passages of a compactor acting from the surface, said blade comprising a second vertical fin attached on the upper portion of the blade, the front of the second vertical fin being provided with a hole and, at the rear of the second vertical fin being provided with three holes spaced in the direction of the height, the two fins being positioned against one another by aligning the two front holes and by pushing into the two front holes fastening means which allow rotation of the second vertical fin on the surface of the first vertical fin, the rear holes on each of these fins being spaced so that when the second vertical fin is rotated on the first vertical fin, only one of the rear holes of the second vertical fin corresponds to only one rear hole of the first vertical fin, to obtain three positions of the fins relative to each other and thus three different eccentricities for said blade.

8. The device according to claim 1, comprising a tractor vehicle used to drive a rigid frame provided with means to maintain at a specified and adjustable depth (H) under the soil level, a plurality of the wedge-shaped tools.

9. The device according to claim 8, further comprising:

means to communicate a vibrating movement to said frame; and an elastic fastener to uncouple the frame from the tractor vehicle regarding vibrations.

10. The device according to claim 1, comprising a rotor having at least one star provided with a set of spokes, wherein the wedge-shaped tool is attached to the end of at least one of said spokes, said rotor being rotated and being disposed under a protective hood, the whole assembly being driven in a translation movement which is horizontal and perpendicular to the axis of the rotor to compact a land strip with a width inferior to the width of the hood.

11. The device according to claim 10, wherein the direction of rotation of the rotor is the same as the direction of motion of the whole assembly.

12. The device according to claim 10, wherein the rotor/hood assembly is attached to a carrier vehicle at the front, at the middle or at the rear of said vehicle.

13. The device according to claim 12, wherein said carrier vehicle is a stabilizer comprising a rotor provided with stars, at least one of the stars being provided with the wedge-shaped tool, and wherein said star has at least one thick tooth which wears at the same rate as said wedge-shaped tool.

14. The device according to claim 1, wherein the device comprises at least two wedge-shaped tools, said blades of these two wedge-shaped tools being transversely distributed between ribs and between side faces, on one or more rows at the same depth or at different depths, to form a rigid frame to compact in a single pass a thick layer to form a compacted base rock at a desired density.

15. The device according to claim 14, wherein said blades are spaced in a height direction to obtain a compacted layer having a height is greater than a height that can be achieved with a single pass.

16. The device according to claim 14, further comprising, before said blades, a small diameter shaft provided with easily exchangeable picks, to form a small milling tool allowing separation of the soil from a ballast before said blades in order to facilitate adjustment and compaction of said layer, driving of the rotor being affected by a motor reducer located within said side faces forming said rigid frame.

17. The device according to claim 14, wherein, for the treatment of soils under the ballast of railway tracks, the device further comprises:

means for an initial grading of at least one trench to engage an engine of a milling tool;

means to ensure levelling of a hydraulic binder;

means for mixing said binder with said soil; and a plurality of wedge-shaped tools to carry out the compacting of this mixture into a thick layer.

18. The device according to claim 17, wherein the mixing means comprises a large diameter milling tool having a horizontal axis perpendicular to a direction of motion of a railcar and on which are attached members such as teeth, which allows the mixing of the soil subjected to treatment with said hydraulic binder.

19. The device according to claim 18, further comprising:

probes;

means for processing signals from the probes; and means for adjusting the depth of the compacting tool based on results of the signal processing.

20. A soil compacting device, comprising:

a frame supporting a heel having a convex surface, from a front to a rear of the device in an advance direction of the device, with a convexity toward soil depth in a working position of the device, the frame including a vertical post, a front wedge-shaped tool being on a front part of the heel, an edge of the wedge-shaped tool forming a leading edge provided at the front of the frame and parallel to a surface of soil, the leading edge having the same width as the heel, the front wedge-shaped tool being disposed closer to the vertical post of the frame than the convex surface of the heel such that a part or the entire convex surface of the heel is configured to be disposed below the surface generated by the leading edge when the tool is advanced parallel to the soil, the heel compacting the soil as the device is advanced;

an intermediate part provided with a known support, which includes a longitudinal hole configured to receive soil decompacting tools, a flat part being disposed on a lower portion of said support, said flat part being attached on a lower end of said support, the front end of the lower portion of the flat part being provided with a first vertical fin with a hole at the front, a rear end of the lower portion of the flat part being provided with three holes spaced in a height direction, the support/flat part assembly forming said intermediate part; and a compacting part provided with a blade having a curved shape whose concavity is directed upward, said blade reproducing a curve of settlement under a repeated effect of the passages of a compactor acting from the surface, said blade comprising a second vertical fin attached on the upper portion of the blade, the front of the second vertical fin being provided with a hole and, at the rear of the second vertical fin being provided with three holes spaced in the direction of the height, the two fins being positioned against one another by aligning the two front holes and by pushing into the two front holes fastening means which allow rotation of the second vertical fin on the surface of the first vertical fin, the rear holes on each of these fins being spaced so that when the second vertical fin is rotated on the first vertical fin, only one of the rear holes of the second vertical fin corresponds to only one rear hole of the first vertical fin, to obtain three positions of the fins relative to each other and thus three different eccentricities for said blade, wherein the soil compacting device is configured to compact the soil through forward advancement of the device parallel to the soil.

* * * * *